US005099545A

United States Patent [19]

Krasznai et al.

[11] Patent Number: 5,099,545

[45] Date of Patent: Mar. 31, 1992

[54] VACUUM CLEANER INCLUDING A SQUEEGEE

[75] Inventors: Charles Z. Krasznai, Trumbull, Conn.; John B. Mallow, Fayetteville, N.C.

[73] Assignee: Black & Decker Inc., Newark, Del.

[21] Appl. No.: 575,466

[22] Filed: Aug. 28, 1990

[51] Int. Cl.[5] ..... A47L 5/24; A47L 9/10; A47L 5/00; A47L 9/06

[52] U.S. Cl. ..... 15/344; 15/353; 15/401; 15/414; 15/420

[58] Field of Search ..... 15/344, 414, 401, 415.1, 15/420, 350, 416, 417, 418, 422, 421, 395, 353

[56] References Cited

U.S. PATENT DOCUMENTS

| | | | |
|---|---|---|---|
| 2,118,070 | 5/1938 | Connor | 15/415.1 |
| 2,960,713 | 11/1960 | Wistrand | 15/422 |
| 3,079,623 | 3/1963 | Congdon | 15/401 |
| 3,135,986 | 6/1964 | Tolin | 15/422 |
| 3,952,362 | 4/1976 | Torii | 15/416 |
| 4,011,624 | 3/1977 | Proett | 15/344 |
| 4,045,840 | 9/1977 | Johansson | 15/422 |
| 4,459,720 | 7/1984 | Ahlf et al. | 15/416 |
| 4,573,234 | 3/1986 | Kochte et al. | 15/350 |
| 4,573,237 | 3/1986 | Kochte et al. | 15/344 |
| 4,610,048 | 9/1986 | Ishihara | 15/344 |
| 4,905,342 | 3/1990 | Ataka | 15/344 |
| 4,918,857 | 4/1990 | Wade et al. | 15/415.1 |
| 4,920,608 | 5/1990 | Hult et al. | 15/344 |

FOREIGN PATENT DOCUMENTS

| | | | |
|---|---|---|---|
| 3337342 | 11/1984 | Fed. Rep. of Germany | 15/344 |
| 0186190 | 10/1922 | United Kingdom | 15/422.1 |
| 0717578 | 10/1952 | United Kingdom | 15/344 |

*Primary Examiner*—Harvey C. Hornsby
*Assistant Examiner*—Tony G. Soohoo
*Attorney, Agent, or Firm*—Barry E. Deutsch

[57] ABSTRACT

A vacuum cleaner includes a motor, a housing enclosing the motor, a fan driven by the motor for producing a vacuum, a canister removably attached to the front end of the housing and having an intake nozzle for reception of foreign matter, liquid and air drawn into the canister in response to the vacuum developed by the fan. The intake nozzle includes a converging section extending from the front of the nozzle towards the center thereof and a diverging section extending from the terminus of the converging section towards the terminus of the nozzle. A squeegee is disposed in said nozzle and has a main body portion including at least one flow passage defined by a forward converging section terminating in a generally constant diameter section. The end of said constant diameter section is generally aligned with the terminus of the converging section of the nozzle. A flapper valve overlies the end of said constant diameter section of said squeegee and is integrally molded with said main body portion.

3 Claims, 2 Drawing Sheets

VACUUM CLEANER INCLUDING A SQUEEGEE

BACKGROUND OF THE INVENTION

This invention relates generally to hand-held vacuum cleaners capable of picking up both wet and dry debris, and in particular, to vacuum cleaners of the type having a squeegee for maintaining the performance of the cleaner during wet cleanup and for enabling the design of other components of the cleaning unit to be optimized for dry cleanup.

Many homes are presently equipped with hand-held vacuum cleaners capable of picking up both wet and dry debris. Heretofore, designers of such vacuum cleaners have been forced to accept compromised performance in cleaning either type of debris to make the cleaner capable of picking up both types of debris. For example, wet debris, since it is relatively heavier than dry debris, requires the cleaner to produce a relatively greater vacuum to achieve desired cleaning performance.

To improve the wet pick-up performance of the cleaner, the diameter of the cleaner's inlet nozzle has been reduced and a squeegee has been inserted into the intake nozzle to clean wet debris. The reduced diameter size of the inlet nozzle has limited dry pickup performance of the cleaner with respect to large particles.

Some hand-held vacuum cleaners capable of either wet or dry pickup, also have a tendency to drip after the cleaner has been turned off and wet debris has been collected in the cleaner's canister. Such dripping can create user dissatisfaction.

Accordingly, it is an object of this invention to improve the wet and dry performance of hand-held vacuum cleaners.

SUMMARY OF THE INVENTION

The foregoing object and other object of the invention are attained in a vacuum cleaner including a motor, a housing enclosing the motor, a fan driven by the motor for producing a vacuum, a canister removably attached to the front end of the housing and having an intake nozzle for reception of foreign matter, liquid and air drawn into the canister in response to the vacuum developed by the fan, said intake nozzle including a converging section extending from the front of the nozzle towards the center thereof and a diverging section extending from the terminus of the converging section towards the terminus of the nozzle and a squeegee disposed in said nozzle and having a main body portion including at least one flow passage defined by a forward converging section terminating in a generally constant diameter section, the end of said constant diameter section being generally aligned with the terminus of the converging section of the nozzle; and a flapper valve overlying the end of said constant diameter section of said squeegee and being integrally molded with said main body portion.

DESCRIPTION OF THE PREFERRED EMBODIMENT

Figure 1:
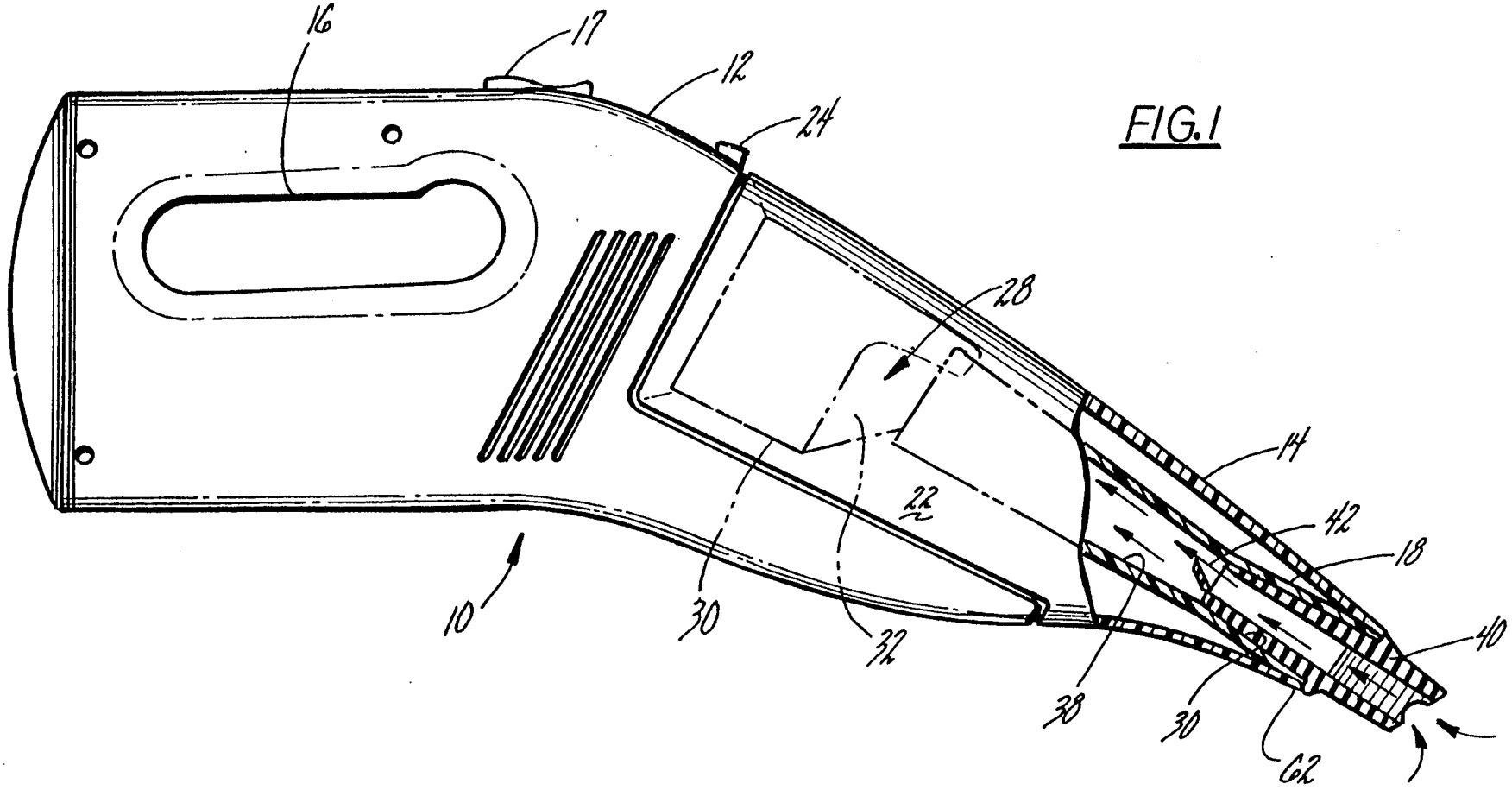
FIG. 1 is a side elevational view, partially in section, of a hand-held vacuum cleaner including the present invention.
Figure 2:
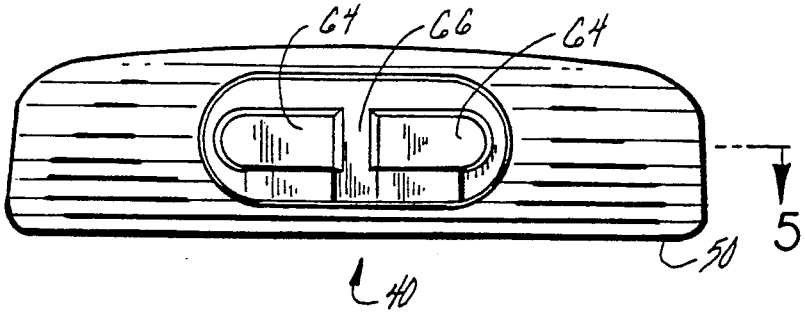
FIG. 2 is a rear elevational view of an attachment for the vacuum cleaner illustrated in FIG. 1.
Figure 3:
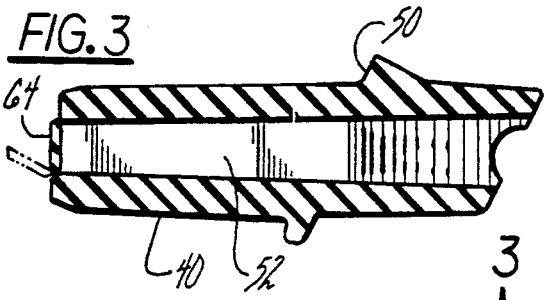
FIG. 3 is a sectional view taken along line 3—3 of FIG. 4.
Figure 4:
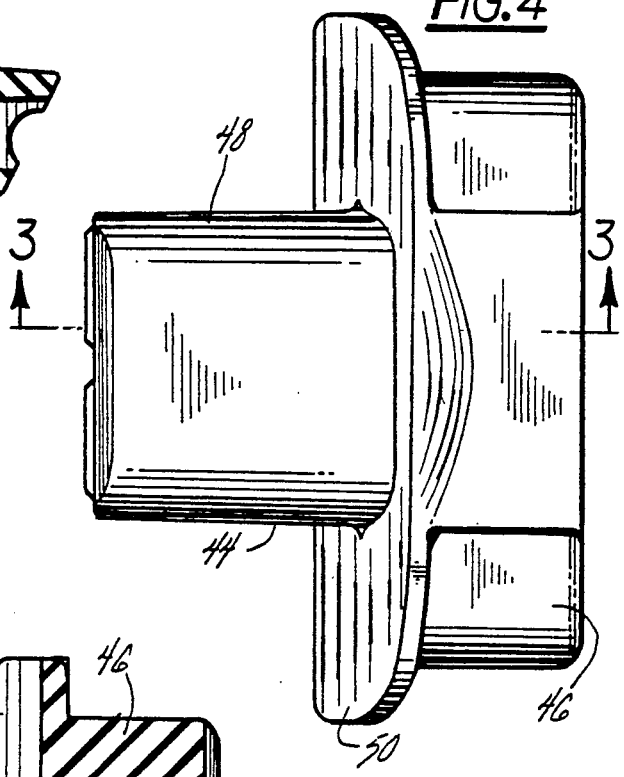
FIG. 4 is a somewhat perspective top view of the attachment illustrated in FIG. 2.
Figure 5:
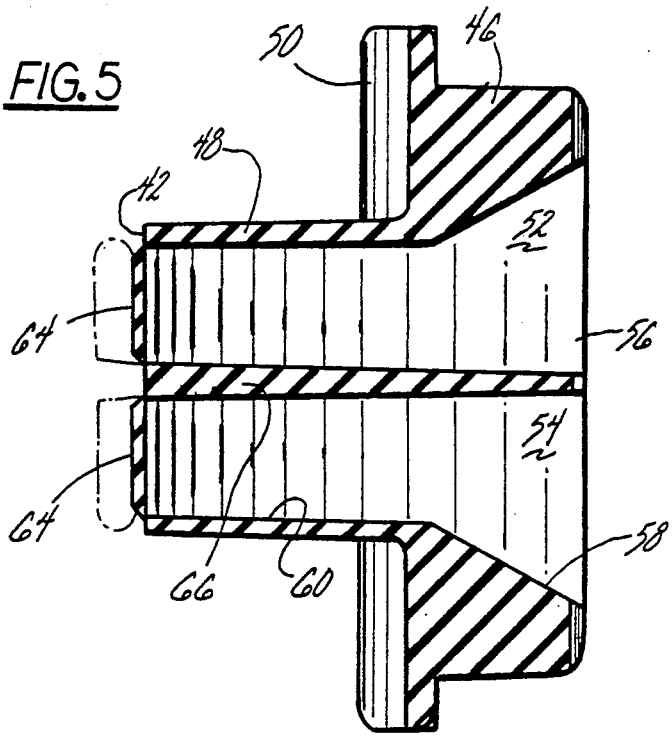
FIG. 5 is a sectional view taken along line 5—5 of FIG. 2 illustrating further details of the attachment for the hand-held vacuum cleaner.

Referring now to the various figures of the drawing, a hand-held vacuum cleaner embodying the present invention is shown. In referring to the various figures of the drawing, like numerals shall refer to like parts.

Referring specifically to FIG. 1, a vacuum cleaner 10 is illustrated. Vacuum cleaner 10 comprises a central housing 12 having a canister 14 affixed to a front end thereof and a handle 16 formed near the back end thereof. Handle 16 is configured to be grasped by the hand of a person using the vacuum cleaner for the cleaning of upholstery or rugs, as well as in the dusting of flat surfaces such as the top of a table. As disclosed in co-pending application Ser. No. 498,135, filed Mar. 19, 1990 entitled Filter Assembly For A Vacuum Cleaner and assigned to the same assignee as the assignee hereof, vacuum cleaners of the present type typically have a source of suction or a fan (which may also be referred to as a blower or impeller), an electric motor coupled by a shaft to the fan and a power source such as batteries for driving the motor. These elements are typically housed within housing 12. A switch 17 positioned on the upper side of handle 16, typically provides for the coupling of electric power from the batteries to the motor for activation of the motor.

Canister 14 includes a nozzle 18 at its closed end 20 which opens into a storage chamber 22. Storage chamber 22 is used for the collection of any liquid and dirt which may be drawn by suction or vacuum into cleaner 10. Canister 14 is removably attached to the forward end of housing 12 by means of a latch member 24 or the like.

A filter assembly 28 is removably disposed within canister 14. As shown in detail in the previously cited co-pending application Ser. No. 498,135, filter assembly 28 comprises a filter housing 30 having a deflecting surface 32 to deflect any incoming liquid which flows from nozzle 18 away from the flow of the air stream, and a filter (not shown) disposed within filter housing 30.

Nozzle 18 as illustrated in FIG. 1, has a first converging section 36 and a section diverging section 38. The converging section of the nozzle increases the speed of particles flowing within this section, while the pressure within the nozzle is simultaneously decreased. The diverging section 38 of the nozzle permits relatively large diameter debris to readily pass from the nozzle into the storage chamber 28. The converging section 36 of nozzle 18 improves the wet pick-up performance of cleaner !0, while diverging section 38 of the nozzle improves the dry pick-up performance of the cleaner.

When it is desired to clean up wet debris, squeegee 40 is inserted into the converging portion of the nozzle. The rearward end 42 of squeegee 40 terminates generally at the transition point between the converging and diverging sections of nozzle 18. End 42 of squeegee 40 is generally axially aligned with the terminus of converging section 36 of nozzle 18.

Referring specifically to FIGS. 2–5, details of squeegee 40 shall now be described. The squeegee includes a main body portion 44 having a first section 46 and a second section 48. A flange-like member 50 separates first 46 and second 48 sections of the main body portion of the squeegee. Squeegee 40 is manufactured from rubber or a suitable alternative such as neoprene.

The main body portion of the squeegee has a pair of flow passages 52, 54 extending from the forward end 56 of the squeegee to its rearward end 42. Each of the flow passages 52, 54 comprise a forward converging section 58 terminating in a generally constant diameter section 60. The end 42 of the constant diameter section 60 is generally aligned with the terminal portion of converging section 36 of inlet nozzle 18.

Flange-like member 50 is angled to conform to the angle formed by front face 62 of canister 14 of vacuum cleaner 10. When squeegee 40 is inserted into the nozzle, flange-like member 50 mates with front face 62 of the canister to form a substantially water and air tight seal.

A flap-like valve 64 overlies the end of each flow passage through the squeegee. Each valve 64 is normally biased so that a small gap exists at the outlet of each flow passage.

During normal operation, valves 64 move relative to the exit opening from each passage 52, 54 to permit full fluid flow through the squeegee. When the vacuum cleaner is switched off, the pressure in the canister rises so that the pressure on each side of each flapper valve is substantially equal. The valves will then return to their normal position. Each of the valves 64 are integrally molded with the squeegee. The hinge for each valve is molded from the material forming the squeegee.

Squeegee 40 includes a reinforcing rib 66 separating the two air flow passages. The reinforcing rib provides structural support for the squeegee to retain its original shape.

End 42 of squeegee 40 as discussed above is generally aligned with the terminus of the converging section of nozzle 18. This arrangement is desired to make insertion of the squeegee into the converging — diverging nozzle relatively easy. Also, eddy currents are less likely to form in diverging portion 38 of the nozzle and the end of the squeegee is therefore less likely to create pockets of water within the nozzle.

While a preferred embodiment of the present invention has been described and illustrated, the invention should not be limited thereto, but may otherwise be embodied within the scope of the following claims.

What is claimed is:

1. A vacuum cleaner including a motor, a housing enclosing the motor, a fan driven by the motor for producing a vacuum, a canister removably attached to the front end of the housing and having an intake nozzle for reception of foreign matter, liquid and air drawn into the canister in response to the vacuum developed by the fan, said intake nozzle including a first section that has a converging cross-sectional are in the direction of flow extending from the front of the nozzle towards the center thereof and a second section that has a diverging cross-sectional area in the direction of flow extending from the terminus of the converging section towards the terminus of the nozzle, and a squeegee disposed in said nozzle and having a main body portion including at least one flow passage defined by a forward section that has a converging cross-sectional area in the direction of flow terminating in a generally constant diameter section, the end of said constant diameter section being generally axially aligned with the terminus of the converging section of the nozzle and a flapper valve overlying the end of said constant diameter portion of said squeegee and being integrally molded with said main body portion.

2. A vacuum cleaner in accordance with claim 1 wherein the main body portion of said squeegee includes a pair of flow passages separated by an axially extending reinforcing rib integrally molded with said main body portion, each air passage having a flapper valve overlying the end thereof.

3. A vacuum cleaner in accordance with claim 2 wherein each flapper valve is normally biased towards a slightly open position relative to its respective flow passage.

* * * * *